US009840401B2

(12) United States Patent
Hansen et al.

(10) Patent No.: US 9,840,401 B2
(45) Date of Patent: Dec. 12, 2017

(54) LOAD GUIDING ARRANGEMENT

(71) Applicant: SIEMENS AKTIENGESELLSCHAFT, München (DE)

(72) Inventors: Steen Mattrup Hansen, Svendborg (DK); Jesper Moeller, Brande (DK); Kenneth Helligsoe Svinth, Aarhus C (DK)

(73) Assignee: Siemens Aktiengesellschaft (DE)

( * ) Notice: Subject to any disclaimer, the term of this patent is extended or adjusted under 35 U.S.C. 154(b) by 0 days.

(21) Appl. No.: 14/490,700

(22) Filed: Sep. 19, 2014

(65) Prior Publication Data

US 2015/0183620 A1 Jul. 2, 2015

(30) Foreign Application Priority Data

Dec. 30, 2013 (EP) ..... 13199785

(51) Int. Cl.

| | |
|---|---|
| ***B66C 23/18*** | (2006.01) |
| ***B66C 23/52*** | (2006.01) |
| ***B66C 23/62*** | (2006.01) |
| ***B66C 13/06*** | (2006.01) |
| ***B66C 13/08*** | (2006.01) |

(52) U.S. Cl.

CPC ..... *B66C 13/06* (2013.01); *B66C 13/08* (2013.01); *B66C 23/185* (2013.01); *B66C 23/52* (2013.01); *B66C 23/62* (2013.01)

(58) Field of Classification Search

CPC ..... B66C 13/06; B66C 13/08; B66C 23/52; B66C 23/62; B66C 23/185; B66C 13/00; B66C 13/04; B66C 23/00; B66C 23/207

USPC ..... 212/274

See application file for complete search history.

(56) References Cited

U.S. PATENT DOCUMENTS

| | | | |
|---|---|---|---|
| 2011/0272375 | A1 | 11/2011 | Willim |
| 2011/0272377 | A1 | 11/2011 | Richter |

(Continued)

FOREIGN PATENT DOCUMENTS

| | | | |
|---|---|---|---|
| CN | 2388170 | Y | 7/2000 |
| CN | 102241370 | A | 11/2011 |
| CN | 102701086 | A | 10/2012 |

(Continued)

OTHER PUBLICATIONS

Extended European Search Report; Application No. 13199785.0, 5 pgs.

(Continued)

*Primary Examiner* — Emmanuel M Marcelo
*Assistant Examiner* — Juan Campos, Jr.
(74) *Attorney, Agent, or Firm* — Schmeiser Olsen & Watts LLP

(57) ABSTRACT

A load guiding arrangement realized for mounting to a crane, which load guiding arrangement comprises a number of load guides, wherein a load guide comprises a guide wire extending from a lower level of the crane to an upper level of the crane; a bridging connector realized to bridge a gap between the guide wire and a control wire, which bridging connector is free to travel along the guide wire and the control wire according to a vertical displacement of a load; and a control wire extending from a lower level of the crane, through the bridging connector to a lifting connector for connecting to the load (4), and through the bridging connector again to an upper level of the crane is provided.

15 Claims, 6 Drawing Sheets

(56) References Cited

U.S. PATENT DOCUMENTS

| | | | |
|---|---|---|---|
| 2012/0061341 | A1 | 3/2012 | Richter |
| 2013/0129452 | A1 | 5/2013 | Vehmeijer |

FOREIGN PATENT DOCUMENTS

| | | | |
|---|---|---|---|
| DE | 2410807 | A1 | 9/1975 |
| EP | 0471305 | A1 | 2/1992 |
| EP | 1925582 | A1 | 5/2008 |
| EP | 2084098 | B1 | 2/2011 |
| EP | 2364949 | A1 | 9/2011 |
| GB | 191002396 | A | 0/1910 |
| JP | H06156975 | A | 6/1994 |
| WO | WO 2011048220 | A1 | 4/2011 |
| WO | WO 2011088832 | A1 | 7/2011 |

OTHER PUBLICATIONS

Claims feature matrix.
Fyhn Friis Jesper; Affidavit; 2017.
Statement by Kenneth Kristiansen.
Annex 1 to notice of opposition with screen dumps from E1.
Botwright Adrian; Affidavit; 2017.
101371 Request for approval (Crane on Discovery Traverse System); pp. 1-17; 2012.
Siemens Wind POWE1-20R, Technical report on traverse system used on off shore crane; Huismann boom A07-46000 Tugger system; pp. 1-13; 2011.
Photographs from MPI Discovery—Kaarehamn; 2013.
Installation guide; Traverse system on Discovery; AH Industries; pp. 1-18; 2013.
AH Industires Triangle left Rev A.
Vestas; "Reducing installation time by 25% in offshore"; [https://www.youtube.com/watch?v=4gSGqBjOK3g]; Kaarehamn V112; pp. 1-9; 2013.
reNEWS; "V112 takes the stage at Karehamn"; renews Eight V112s installed at Kaarehamn; pp. 1-3; 2013.
CE—declaration of conformity traverse system (Discovery traverse system); AH Industries; Request for approval; pp. 1-16; 2012.
Kristiansen, Kennet et al; Service report; AH Industries; 2013.
reNEWS; "First offshore V112s ship out", shipped for Kaarehamn; pp. 1-3; 2013.
AH Industries; "A Tagline Master with endless possibilities"; pp. 1-26; 2013.
Offshore Wind; "Vestas Ships First V112-3.0 MW Offshore Turbines to Sweden"; pp: 1-2; 2013.
Modern Power Systems; "Vestas marks offshore milestone"; pp. 1; 2013.
AH Industries Top traverse right Rev B.
AH Industries Projects—evidence image 4.
MPI Offshore; "Print out from homepage re. Discovery installing six offshore windmills in Karehamn, Sweden in Mar. 2013 to May 2013"; http://www.mpi-offshore.com/mpi-projects/first-vestas-offshore-turbines-installed-by- mpi-discovery/; 2017.
Evwind, Wind Energy; "Vestas ships first V 112-3.0 MW offshore wind turbines", evwind V112s shipped for Kaarehamn; pp. 1-3; 2013.
AH Industries Projects; CE marking for bottom traverse (04320100), top traverse (4320400) and top wire clamp (09510200) as mounted on the Endeavour.
Lasse, Andersen et al; Work at Disvovery; Service report; AH Industries; 2013.
Siemens Wind Power; User manual; Traverse System used on off-shore crane-vessel Endeavour; Husman Boom A07-46000-tugger system; pp. 1-19; 2011.
Email correspondence II between AH industries Projects and Siemens Wind Power Denmark dated Jan. 7-14, 2011.
Email correspondence between AH industries Projects and Siemens Wind Power Denmark regarding Purchase Order number (PO).
Statement by Lasse Andersen.
AH Industries—rev. A Small triangle left.
reNEWS; "First offshore VI12 rises", V112s installation started at Kaarehamn; pp. 1-2; 2013.
AH Industries; "AHI Tagline Master"; [https://www.youtube.com/watch?v=KdnNiRkecR4; AHI video; pp. 1-2; 2013.
Opposition filed by Vestas Wind System A/S on May 24, 2017 against the European Patent EP2889251 (which is a counterpart to this U.S. Appl. No. 14/490,700).
Opposition filed by AH Industries A/S on May 19, 2017 against the European Patent EP2889251 (which is a counterpart to this U.S. Appl. No. 14/490,700).
Brief Communication dated Jun. 27, 2017 (Letter from the Opponent) for Application No. 13199785.0; 3 pgs.
Chinese Office Action dated May 9, 2017 for Application No. 201410838867.4, 19 pgs.
AH Industries "AH Industries—Tagline Master"; Published on YouTube Aug. 8, 2013; https://www.youtube.com/watch?v=KdnNiRkecR4.
AH Industries "AH Industries—Tagline Master", Published on YouTube Aug. 6, 2013; https://www.youtube.com/channel/UCERNUY5J2IpIijIsBjA.
Vestas "Reducing installation time by 25% in offshore", Published on YouTube Oct. 18, 2013; https://www.youtube.com/watch?v=4gSGgBj0k3g.

LOAD GUIDING ARRANGEMENT

CROSS-REFERENCE TO RELATED APPLICATIONS

This application claims priority to EP Application No. 13199785.0 having a filing date of Dec. 30, 2013, the entire contents of which are hereby incorporated by reference.

FIELD OF TECHNOLOGY

The following relates to a load guiding arrangement, a crane with a load guiding arrangement, and a method of operating such a crane.

BACKGROUND

To assemble a wind turbine, generally the wind turbine tower is first secured to a foundation, and a nacelle is then hoisted into place and secured to the tower. In a final assembly step, the rotor blades are hoisted into place and mounted to a hub at the front of the nacelle. To lift these heavy components into place, a suitable crane construction is used, and the load is suspended from a lifting cable. Generally, some kind of gripping means or lifting frame may be used to grip the heavy component during lifting, and the gripping means with load is suspended from a lifting hook on the lifting cable. A problem associated with the assembly procedure is that the components must be lifted to a considerable height, particularly in the case of large generators, since these are generally also mounted on top of very high towers. A tower height in excess of 100 m is no longer the exception. Furthermore, the components themselves are very heavy. A large generator, with a correspondingly large number of magnet poles and stator coils may weigh in excess of 330 metric tons. Similarly, the rotor blades of a large generator may be very long, and may be 50-80 m or more in length. Lifting such large, heavy and unwieldy components can be made even more difficult if weather conditions are unfavorable, since the heavy load is essentially only suspended from a single lifting cable. Wind gusts can cause the load to swing and become dangerously unstable. Therefore, prior art assembly methods may only be carried out in calm weather, which may be rare particularly for offshore wind locations. One approach at dealing with this problem involves arranging a sliding carriage on the crane, and fixing one end of a tag wire to the load. The tag wire passes over the carriage. The carriage can be pulled upwards by a cable connected to a winch. As the load is raised, the carriage is pulled upwards. The tag wire can be held under tension so that a swaying or swinging motion of the load is restricted. However, the effectiveness of this approach is limited, and care must be taken to synchronize the upward motion of the carriage, and the paying out of the tag wire, with the upward motion of the load.

SUMMARY

An aspect relates to an improved way of securely and safely lifting a load.

According to embodiments of the invention, the load guiding arrangement is realized for mounting to a crane, and comprises a number of load guides, wherein a load guide comprises a guide wire extending from a lower level of the crane to an upper level of the crane; a bridging connector realized to bridge a gap between the guide wire and a control wire, which bridging connector is free to travel along the guide wire and the control wire according to a vertical displacement of the load; and a control wire extending from a lower level of the crane, through the bridging connector to a lifting connector for connecting to a load, and back through the bridging connector again to an upper level of the crane.

An advantage of the load guiding arrangement according to embodiments of the invention is that it is easier to control the horizontal movement of the load during installation, since the control wire is connected to the load, but is also coupled to the guide wire by means of the bridging connector, which is free to travel along the guide wire and control wire. Therefore, as the load is lifted (or lowered), the bridging connector moves in an upward (or downward) direction. This ensures that the resulting lateral portion of the control wire extending between bridging connector and load will correspond to a "shortest path" between bridging connector and load, for example this lateral portion will be essentially horizontal in the case of a load guide with essentially vertical guide and control wires. Tension in the control wire will act as an inward pulling force on the lifting connector and therefore also on the load. In this way, an uncontrolled horizontal displacement or oscillation of the load can be prevented. An entire lifting maneuver can therefore be carried out in a favorably secure and controlled manner.

According to embodiments of the invention, the crane is realized for lifting a heavy load and comprises a lifting wire for connecting to the load to be lifted; a load winch for controlling tension in the lifting wire; a load guiding arrangement according to embodiments of the invention; and a lifting connector for connecting a control wire of a load guide to the load.

An advantage of the crane according to embodiments of the invention is that it can be used for the assembly of a structure such as a wind turbine, even under unfavorably windy conditions, since the load guiding arrangement ensures that even a heavy and cumbersome load is securely held at all times throughout a lifting maneuver.

According to embodiments of the invention, the method of operating such a crane comprises the steps of arranging a control wire of a load guide over a lifting connector of the load; increasing tension in the guide wire; increasing tension in the control wire; and actuating the load winch to lift the load.

An advantage of the method according to embodiments of the invention is that the step of arranging a control wire of the load guiding arrangement over the lifting connector can be performed before the lifting procedure begins, for example when the load is still resting on the ground. The expression "arranging a control wire over a lifting connector of the load" is to be understood to mean that the control wire can freely move over or through such a lifting connector (depending on how it is realized), in contrast to a prior art approach in which one end of a tag wire is fastened or affixed to the load.

Particularly advantageous embodiments and features of embodiments of the invention are given by the dependent claims, as revealed in the following description. Features of different claim categories may be combined as appropriate to give further embodiments not described herein.

In the following, it may be assumed that the load to be lifted is a wind turbine component. In the context of a crane for lifting a heavy load, a control wire may also be referred to as a "tag wire". In the following, these terms may therefore be used interchangeably. It may also be assumed in the following that a guide wire and its corresponding control or tag wire are arranged essentially parallel to each other along an 'upright' portion of the crane, whereby the term 'upright' need not necessarily mean vertical, as will become clear below.

A load guide can be connected to the crane in any suitable or appropriate manner. Preferably, the wires of a load guide are arranged at a distance from the crane, to prevent them from getting caught on any protruding element. This can be achieved by a lower anchor point, for example on the ground or at a lower crane region, to which one end of a guide wire or tag wire is connected. Similarly, an upper anchor point is used to secure the other end of a guide wire or tag wire at a suitably high position, for example at a point high up on the crane. Preferably, the upper anchor point is at least as high as a point to which the load should be raised. In one embodiment of the invention, the load guiding arrangement comprises a lower traverse for mounting to the crane in a lower region and an upper traverse for mounting to the crane in an upper region, and wherein a wire of a load guide is connected between the lower traverse and the upper traverse. A "traverse" in the context of a crane assembly is a rigid anchor point structure that spans the width of the crane, and can be attached, for example, to the upright members of a framework structure. A traverse can comprise a structural member that protrudes outwards from the crane body in the manner of a truss, and a means of connecting to a wire of a load guide. The upper and lower traverses can be different in construction. Regardless of the manner in which it is realized, an anchor point is preferably structurally strong enough to allow a wire to be tensioned to a satisfactory degree.

As indicated above, the bridging connector is realized to bridge a gap between guide wire and control wire of a load guide, and to be freely moveable along the guide wire and control wire. This can be achieved in any suitable way. In an embodiment of the invention, a bridging connector comprises a housing and a plurality of pulley wheels, wherein a pulley wheel is arranged to travel along a wire of the load guide. For example, the bridging connector can be made of two housing plates in an open casing construction. The housing plates can be arranged parallel to each other, and can be connected by a number of axles about which the pulley wheels are free to rotate. In a preferred embodiment of the invention, the bridging connector comprises at least one guide wire pulley wheel that can roll along the guide wire as the load is being vertically displaced; and at least two tag wire pulley wheels, over which the tag wire can slide as the load is being lifted or lowered. Such a construction may be regarded as a type of 'snatch block' with a plurality of pulley wheels to allow the snatch block to move freely along its guide wire and tag wire. In this way, the snatch block can move to follow a vertical displacement of the load. Effectively, the tag wire follows a path extending from the lower anchor point to the bridging connector, then to the load connector, then back to the bridging connector, and finally to the upper anchor point. The tension in the tag wire, together with the free movement of the tag wire through the bridging connector and load connector, ensures that a lateral tag wire path portion between load connector and bridging connector follows the 'shortest path'. As a result, particularly when the guide wire has an essentially vertical orientation, the lateral tag wire path portions are essentially horizontal.

During a lifting procedure, the guide wire is preferably held taut so that it does not deflect as the bridging connector moves along it, i.e. so that the bridging connector can travel in an essentially straight line, even if the load is exerting an outward force on the load guide (for example because of high winds). Similarly, the tag wire is also held taut so that a high degree of control is achievable and so that the load can be steadily lifted without any significant lateral displacement, even in strong wind conditions. Therefore, in a preferred embodiment of the invention, the load guiding arrangement comprises a winch arrangement for controlling tension in the wires. For example, a guide wire winch can be secured to a lower anchor point or traverse at the base of the crane to pay out or retract the guide wire, and the other end of the guide wire can be secured to an upper anchor point or traverse near the top of the crane. Similarly, the tag wire tension can be controlled by a tag wire winch, which can also be mounted to a lower traverse or to any other location near the base of the crane. The other end of the tag wire can also be secured near the top of the crane, for example to an upper traverse.

Generally, a crane of the type that is used for lifting a load such as a wind turbine component comprises a framework boom that is tilted when the crane is in its 'upright' or 'boomed-up' position. In one possible realization of the load guiding arrangement according to embodiments of the invention, a guide wire and tag wire can be arranged parallel to the crane boom, so that these will have an essentially sloped path. The distance between the load lifting connector and the bridging connector will therefore be greater near the base of the crane, and smaller near the top of the crane. Clearly, therefore, the lateral tag line portions, and therefore the overall working length of the tag wire, will decrease in length as the load is lifted. Therefore, in such an embodiment, the tension in the tag wire is preferably continually adjusted as the load is being lifted, i.e. the winch is preferably actuated to retract the tag wire according to the upward displacement of the load. The load lifting wire will always be essentially vertical owing to the downward gravity force acting on the load during a lifting procedure. Therefore, in a preferred embodiment of the invention, the upper and lower traverses are realized so that the guide wire and tag wire are also essentially vertical when under tension. The bridging connector will therefore follow an essentially vertical path of travel during a vertical load displacement. In this way, the lateral tag line portions remain essentially constant in length during the lifting procedure.

In prior approaches, one or more tag wire winches are secured to the load. However, a winch of the type required—as well as any mounting means required to mount it to the load—can add significantly to the weight of the load to be lifted. In the load guiding arrangement according to embodiments of the invention, the tag wire winches are secured to the crane or can be secured to the ground, to the deck of an installation vessel, etc. In this way, the overall lifting weight is reduced, and the crane can therefore lift heavier components. In the load guiding arrangement according to embodiments of the invention, a tag wire is realized for mounting to a lifting connector of a wind turbine component lifting arrangement. The lifting connector can simply be a pulley wheel over which the tag wire can travel, so that the tag wire follows a path from the bridging connector to the lifting connector and back again to the bridging connector. Of course, any suitable realization may be used for such a lifting connector.

A single load guide may be sufficient to control a load during a lifting maneuver. Such an embodiment uses a single tag wire and a single lifting connector on the load, and the tag wire can be used to counteract a horizontal displacement of the load during lifting. This may be sufficient to control the lifting procedure during steady wind conditions. However, in a preferred embodiment of the invention, the load guiding arrangement comprises a pair of load guides. Such a preferred embodiment avails of two tag wires and two lifting connectors, so that the load has less degrees of freedom and a greater degree of control is possible. Preferably, the load guides are arranged on either side of the crane boom, and the lifting connectors are arranged on either side of the load. During lifting, then, the load is suspended from a vertical lifting wire, and two tag wires extend horizontally from the lifting connectors towards the crane boom. The tension of the tag wires can be controlled individually in a 'mooring' procedure, so that any forces acting to deflect the load can be countered very accurately by the load guides.

Generally, a winch is driven by a motor connected to a suitable power supply. The winch motors for the guide wires and tag wires can be controlled manually, and a technician observing the lifting procedure can manually operate the winches to adjust the tension of the wires according to the momentary situation. However, in an embodiment of the invention, the load guiding arrangement comprises a remote control means for remote control of the winch arrangement. This can add to the overall safety of the load guiding arrangement. Each winch can be equipped with a remote control module for receiving commands and for actuating the winch accordingly.

A crane of the type used in the assembly of wind turbines at a remote location such as an offshore wind park site is generally transported to the site in a 'boomed-down' position and then erected or 'boomed up' on site. The 'boomed-down' position preferably uses as little space as possible, particularly if the crane must lie on the deck of an installation vessel during transport. To this end, it may be necessary to remove any outwardly protruding anchor points used to secure the guide or tag wires to the crane. Therefore, in a preferred embodiment of the invention, the load guiding arrangement comprises a fold-in arrangement for retracting such an anchor point, for example for retracting an upper traverse. This can be realized in any suitable way. In a preferred embodiment of the invention, the fold-in arrangement comprises a fold-in wire connected to the upper traverse and a fold-in winch for adjusting the tension of the fold-in wire. For example, the upper traverse can be hinged to the crane body, so that the upper traverse can be folded up towards the crane body when not in use. To deploy the upper traverse, it is only necessary to let it fall outward to open the hinge. For example, after completing a lifting procedure, the tag wires can be removed from the load and the tension can be released in the guide wires and tag wires. These are now slack and no longer exert a downward pull on the upper anchor point or upper traverse. Next, the fold-in winch can be actuated to retract the fold-in wire, which results in the upper traverse being folded upwards and inwards. Subsequently, the crane can be boomed down.

BRIEF DESCRIPTION

Some of the embodiments will be described in detail, with reference to the following figures, wherein like designations denote like members, wherein.

In the diagrams, like numbers refer to like objects throughout. Objects in the diagrams are not necessarily drawn to scale.

DETAILED DESCRIPTION

Figure 1:
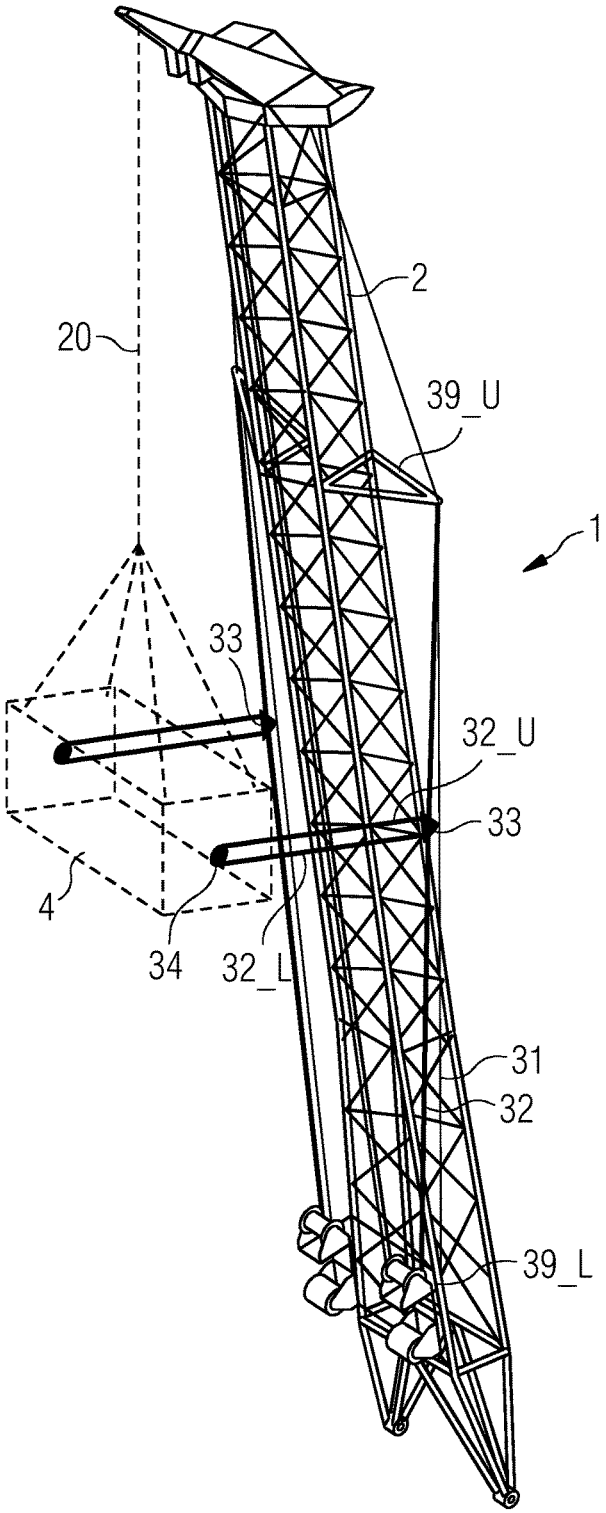
FIG. 1 shows a crane with a load guiding arrangement.

FIG. 1 shows a crane 2 with a load guiding means 1 according to embodiments of the invention. The crane 2 is realized for mounting to an installation vessel for offshore wind turbine assembly, and can lift a load 4 (indicated by the dotted line) to a required height. The crane 2 can be transported to the installation site in a boomed-down position, and can be boomed up into an essentially 'vertical' position as shown here, with a small degree of tilt. The load guiding means comprises a pair of load guides, one on each side of the crane 2, each with a guide wire 31 and a control wire 32 connected between anchor points 39_U, 39L, in this case an upper traverse 39_U and a lower traverse 39_L. In this embodiment, the upper traverse 39_U and lower traverse 39_L are mounted to an open framework of the crane 2. The guide wire 31 and tag wire 32 of a load guide are united by a bridging connector 33 that is free to slide or roll along the guide wire 31.

Figure 2:
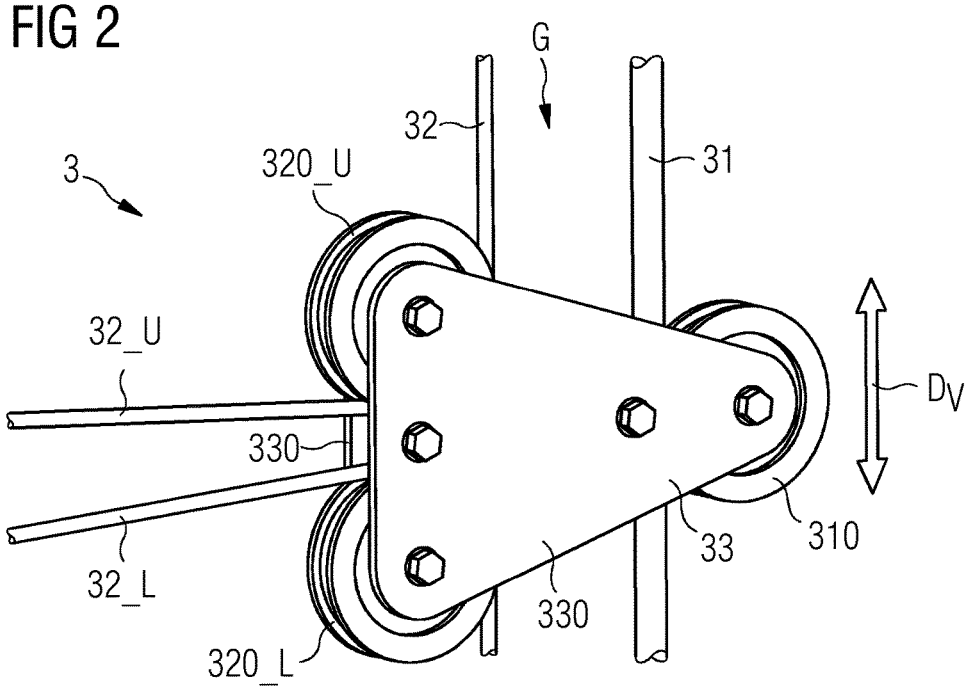
FIG. 2 shows a bridging connector of a load guide in one embodiment of a load guiding arrangement.

Before commencing a lifting procedure, the load 4 is attached to the crane 2 by means of a lifting wire 20. A tag wire 32 is looped over a lifting connector 34 of the load guiding means, mounted to the load 4. Tension in the guide wires 31 and tag wires 32 is increased until these are taut. The load lifting wire 20 is retracted using a lifting winch (not shown) to lift the load upwards. As the load 4 is lifted, the bridging connectors 33 displace horizontal tag line portions 32_U, 32_L between the lifting connector 34 and the bridging connector 33 as the load is being displaced vertically. This is illustrated in FIG. 2, which shows one embodiment of a bridging connector 33 of a load guide 3. In this realization, the bridging connector 33 comprises two flat plates 330 arranged parallel to each other. Three pulley wheels 310, 320_U, 320_L are mounted between the plates 330 so that the pulley wheels 310, 320_U, 320_L are free to rotate. The size of the housing plates 330 and the positions of the pulley wheels 310, 320_U, 320_L are chosen to bridge a gap G between guide wire 31 and tag wire 32. A first pulley wheel 310 is arranged to travel along the fixed guide wire 31 during a vertical displacement $D_V$ of the load. The other two pulley wheels 320_U, 320_L are arranged to displace the upper and lower horizontal tag wire portions 32_U, 32_L according to the vertical displacement $D_V$. Since the tag wire 32 is under tension during a lifting procedure, upper and lower horizontal tag line portions 32_U, 32_L will always lie closely over the respective pulley wheels 320_U, 320_L.

Figure 3:
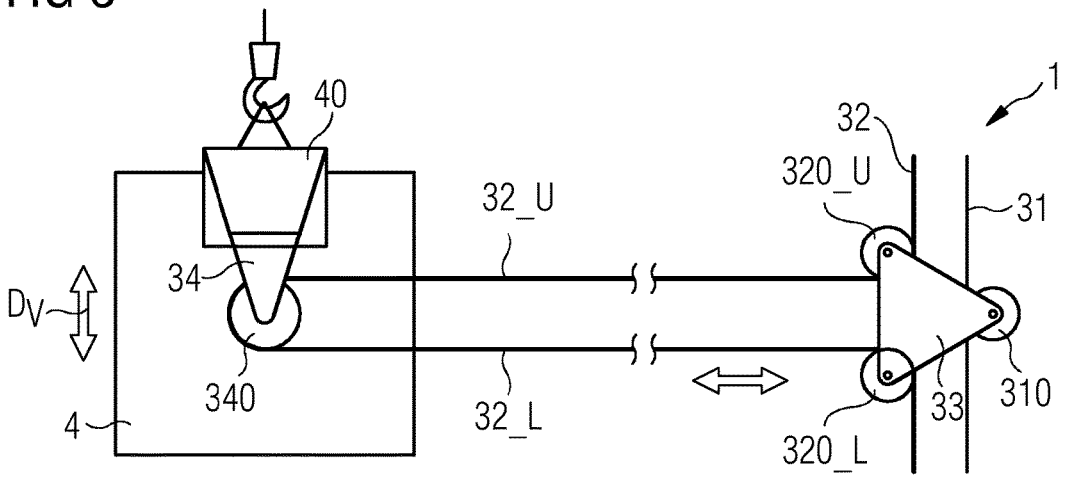
FIG. 3 illustrates a detail of an embodiment of the load guiding arrangement.

FIG. 3 shows the essential components 31, 32, 33, 34 of the load guiding arrangement 1 according to embodiments of the invention. The tag line 32 is free to travel over a part of a lifting connector 34 of the load 4. Here, the load 4 is held in a lifting frame 40 to which the lifting connector 34 is mounted. This comprises a pulley wheel 340 over which the tag line 32 has been looped. This pulley wheel 340 is also free to rotate, so that the tag wire 32 can freely pass through the lifting connector 34 and the bridging connector 33 as the load is lifted or lowered through a vertical displacement $D_V$.

Figure 4:
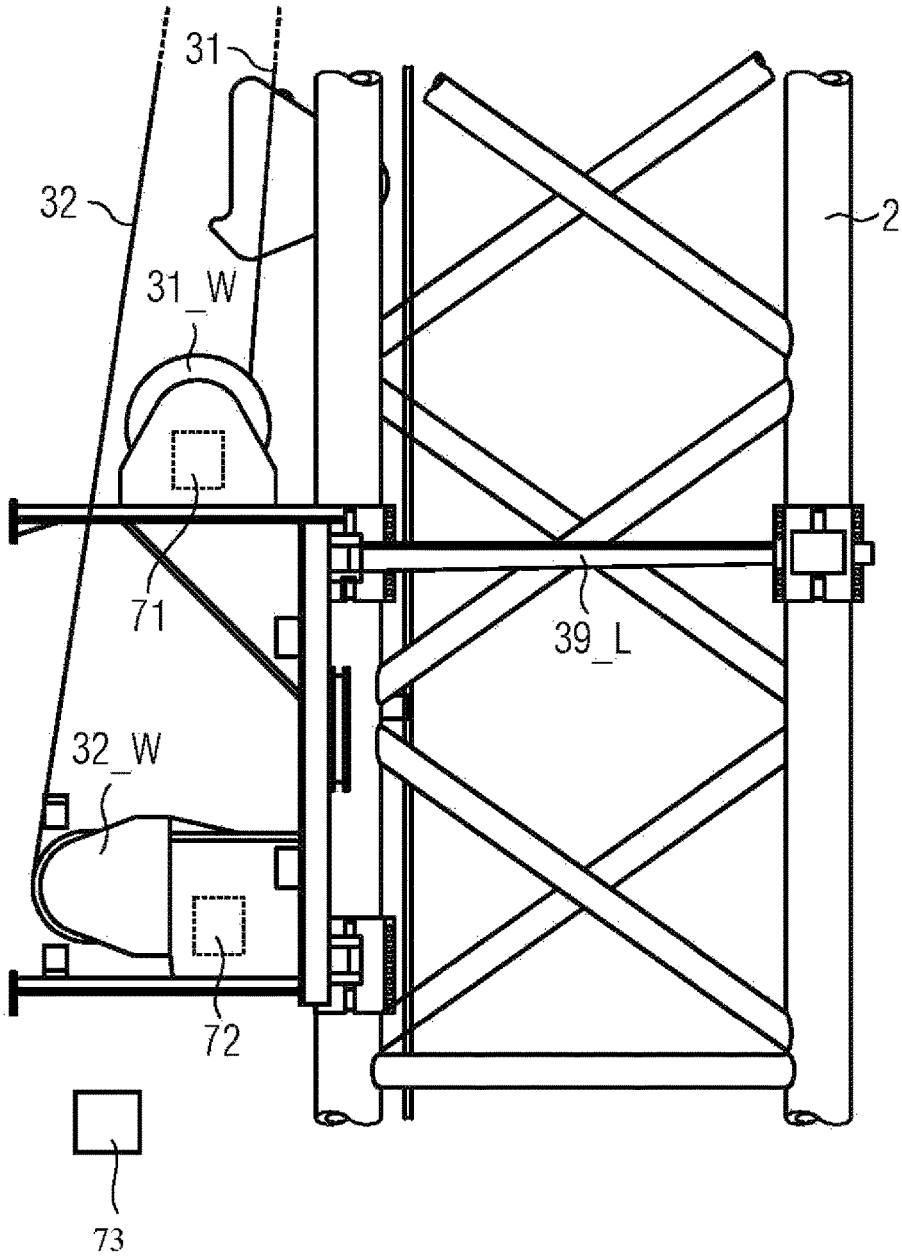
FIG. 4 illustrates a further detail of an embodiment of the load guiding arrangement.

FIG. 4 shows a lower traverse 39_L to which are mounted a guide wire winch 31_W for paying out and retracting a guide wire 31, and a tag wire winch 32_W for paying out and retracting a tag wire 32. While it is advantageous to have the guide wire winch 31_W near the body of the crane 2, so that the guide wire 31 is always close to the crane 2, the tag wire winch 32_W itself could, in an alternative embodiment, be positioned elsewhere, for example on the ground. The bridging connector (not shown) will always ensure that the tag line can guide the load in the desired manner. This embodiment also shows remote control means having remote control interface modules 71, 72 in the winches 31_W, 32_W for receiving instructions from a remote control system 73. The winches 31_W, 32_W are also connected to a power supply (not shown), and the remote control interface modules 71, 72 can actuate the winches 31_W, 32_W according to the instructions received.

Figure 5:
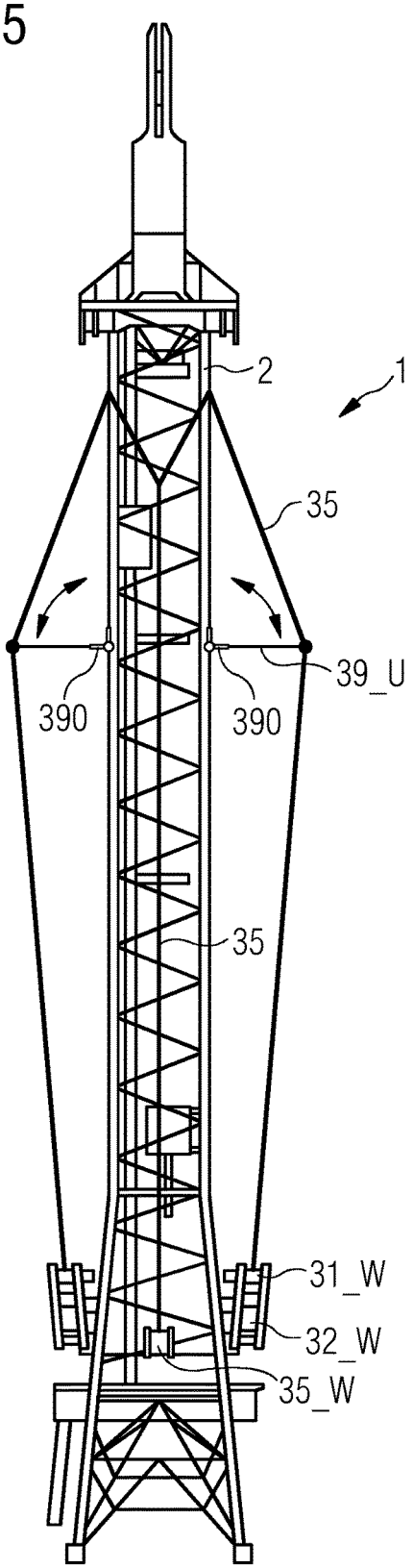
FIG. 5 shows a fold-in arrangement of an embodiment of the load guiding arrangement.

FIG. 5 shows an embodiment of the load guiding arrangement according to embodiments of the invention, with a fold-in arrangement 35, 35_W for folding in a hinged upper traverse 39_U. This is secured to the crane 2 by means of hinges 390 that only allow movement over the angular region indicated by the arrows. The ends of the tag wires and guide wires (only one wire is shown here for the sake of clarity) are fixed to the outer corners of the upper traverse 39_U. A fold-in wire 35 extends from the outer corners of the upper traverse 39_U towards the crane body. In this embodiment, the fold-in wire 35 extends down to the base of the crane and to a fold-in winch 35_W which is realized to retract or pay out the fold-in wire, as required. When the tag wires and guide wires are under tension, a downward force acts on the upper traverse 39_U. When the tension in the tag wires and guide wires has been slackened, there is no longer any downward force acting on the upper traverse 39_U. Then, in order to fold in the upper traverse 39_U, the fold-in winch 35_W can be actuated to retract the fold-in wire 35. This causes the hinged upper traverse 39_U to fold up and in towards the crane body. The crane 2 can then be boomed down for transport. To boom up the crane, the above steps can be carried out in the reverse order.

Figure 6:
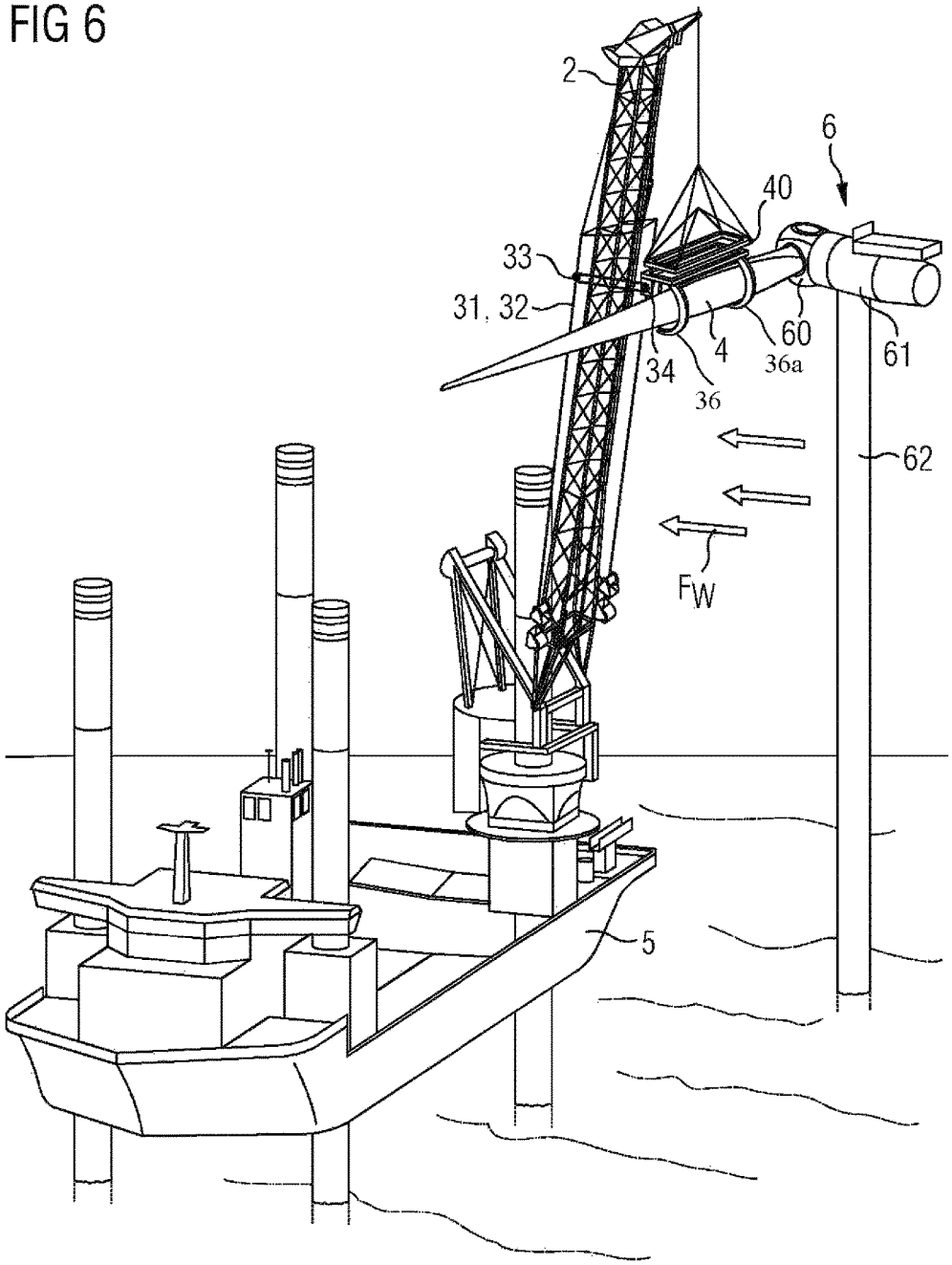
FIG. 6 shows an exemplary situation during a lifting procedure using a crane equipped with a load guiding arrangement.

FIG. 6 shows an exemplary situation during a lifting procedure using a crane 2 equipped with elements 31, 32, 33, 34 of a load guiding means according to embodiments of the invention. Here also, for the sake of clarity, only one wire is shown to represent the guide and control wires 31, 32. The crane is mounted to an installation vessel 5 and can be brought into a boomed-up position as shown here. The crane 2 is being used to lift a rotor blade 4 into position for mounting to a hub 60 of a wind turbine 6 at an offshore location. The rotor blade 4 is held by a plurality of holders 36, 36*a* in a lifting frame 40 which is suspended from a lifting cable 20. The load guides of the lifting arrangement serve to maintain a specific orientation of the rotor blade 4 throughout the lifting procedure, even if wind forces $F_W$ acting on the load 4 would otherwise deflect it from this specific orientation. Here, the wind forces are shown symbolically by arrows, and it will be clear that these wind forces act on any object in the path of the wind. In this way, the lifting procedure can be carried out quickly and efficiently, and the rotor blade 4 can be mounted safely to the hub 60. The hub 60 itself and the nacelle 61 to which it is attached can also have been lifted into place onto the wind turbine tower 62 in previous lifting maneuvers using a crane 2 with the load guiding means according to embodiments of the invention.

Figure 7:
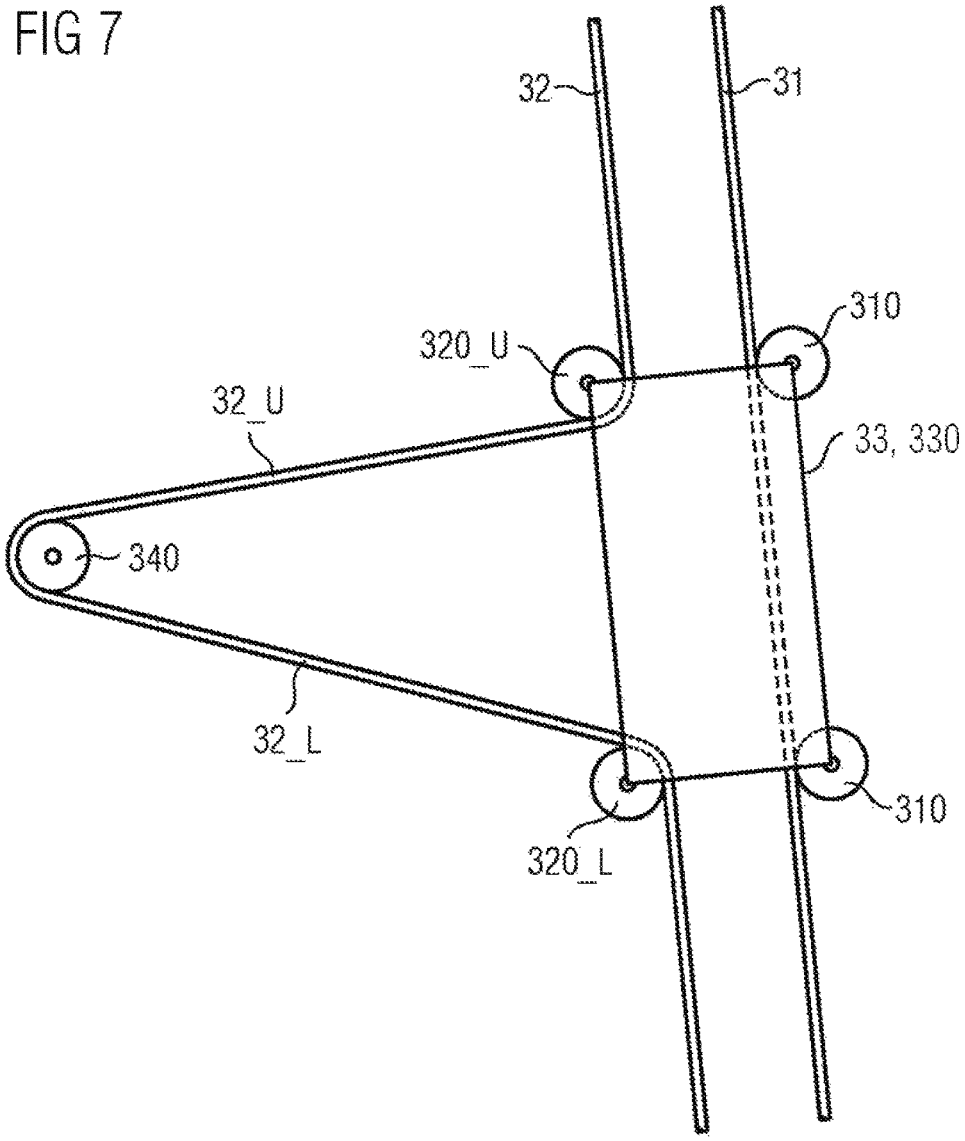
FIG. 7 shows an alternative embodiment of a bridging connector.

FIG. 7 shows an alternative realization of a bridging connector 33. Here, the bridging connector 33 comprises two pulley wheels 310 for travelling along the guide wire 31. The bridging connector 33 is longer than the embodiment shown in FIG. 2, so that the upper and lower pulley wheels 320_U, 320_L are further apart. This allows the tag line portions 32_U, 32_L to follow a slanted path over a pulley wheel 340 of the load connector. This embodiment may be preferred if the guide wire 31 and tag wire 32 follow a sloped crane orientation.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module

The invention claimed is:

1. A load guiding arrangement configured to mount to a crane, the load guiding arrangement including a plurality of load guides, wherein a load guide of the plurality of load guides comprises:

a guide wire extending from a lower level of the crane to an upper level of the crane;

a bridging connector configured to bridge a gap between the guide wire and a control wire, the bridging connector being free to travel along the guide wire and the control wire according to a vertical displacement of a load; and the control wire extending from the upper level of the crane, through the bridging connector to a lifting connector for connecting to the load, and through the bridging connector again to the lower level of the crane;

wherein the bridging connector includes a plurality of pulley wheels, a pulley wheel of the plurality of pulley wheels being arranged to travel along the guide wire;

wherein the bridging connector includes a housing with two housing plates in an open casing construction, and wherein the housing plates are arranged parallel to each other, and are connected by a number of axles about which the pulley wheels are free to rotate whereby the load can be steadily lifted without any significant lateral displacement, even in strong wind conditions.

2. The load guiding arrangement according to claim 1, comprising a winch arrangement for controlling tension in the guide wire.

3. The load guiding arrangement according to claim 2, comprising a remote control means for remote control of the winch arrangement.

4. The load guiding arrangement according to claim 1, wherein the control wire is realized for mounting to the lifting connector of a component lifting frame.

5. The load guiding arrangement according to claim 1, comprising a lower traverse for mounting to the crane in a lower region and an upper traverse for mounting to the crane in an upper region and wherein the guide wire is connected between the lower traverse and the upper traverse.

6. The load guiding arrangement according to claim 1, wherein the plurality of load guides are a pair of load guides.

7. The load guiding arrangement according to claim 6, wherein the pair of load guides are arranged on opposite vertical sides of the crane.

8. The load guiding arrangement according to claim 1, comprising a fold-in arrangement for retracting an upper traverse.

9. The load guiding arrangement according to claim 8, wherein the fold-in arrangement comprises a fold-in wire connected to a hinged upper crane traverse and a fold-in winch for adjusting the tension of the fold-in wire.

10. A crane configured for lifting a load, the crane comprising:

a lifting wire for connecting to the load to be lifted;

a lifting wire winch for controlling tension in the lifting wire;

the load guiding arrangement according to claim 1; and the lifting connector for connecting the control wire of the load guide to the load.

11. A method of operating the crane according to claim 10, comprising:

bringing the crane into an upright position;

arranging a control wire of a load guide over a lifting connector of a load;

increasing tension in a guide wire;

increasing tension in the control wire; and actuating a lifting wire winch to lift the load, so that a bridging connector of the load guide travels along the guide wire and the control wire according to a vertical displacement of the load.

12. The method according to claim 11, wherein the crane is operated to lift a wind turbine component at a wind turbine installation site.

13. The method according to claim 11, comprising the step of adjusting the tension of the guide wire according to wind force acting on the load during a lifting maneuver.

14. The method according to claim 11, comprising the steps of detaching the control wires from the lifting connector;

lowering the tension of the guide wires;

increasing the tension of a fold-in wire of a fold-in arrangement of a load guiding arrangement to retract an upper traverse; and bringing the crane into a boomed-down position.

15. A load guiding arrangement configured to mount to a crane, the load guiding arrangement including a plurality of load guides, wherein a load guide of the plurality of load guides comprises:

a lifting frame having a plurality of holders for holding a component to be raised or lowered, wherein said holders are arranged to hold said component within said lifting frame by said plurality of holders;

a guide wire extending from a lower level of the crane to an upper level of the crane;

a bridging connector configured to bridge a gap between the guide wire and a control wire, the bridging connector being free to travel along the guide wire and the control wire according to a vertical displacement of the component; and the control wire extending from the upper level of the crane, through the bridging connector to a lifting connector for connecting to the lifting frame, and through the bridging connector again to the lower level of the crane;

wherein the bridging connector includes a plurality of pulley wheels, a pulley wheel of the plurality of pulley wheels being arranged to travel along the guide wire;

wherein the bridging connector includes two housing plates in an open casing construction, and wherein the housing plates are arranged parallel to each other, and are connected by a number of axles about which the pulley wheels are free to rotate whereby the load can be steadily lifted without any significant lateral displacement, even in strong wind conditions.

* * * * *